US012637255B2

(12) United States Patent
DeRue et al.

(10) Patent No.: US 12,637,255 B2
(45) **Date of Patent: *May 26, 2026**

(54) CHILD RESISTANT ZIPPER CLOSURE, SLIDER, RECLOSEABLE POUCH AND METHODS

(71) Applicant: Reynolds Presto Products Inc., Lake Forest, IL (US)

(72) Inventors: Nicholas A. DeRue, Farmington, NY (US); Gregg Thompson, Canandaigua, NY (US); Richard Wehrle, New London, WI (US)

(73) Assignee: Reynolds Presto Products Inc., Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/774,616

(22) Filed: Jul. 16, 2024

(65) Prior Publication Data

US 2024/0367863 A1 Nov. 7, 2024

Related U.S. Application Data

(63) Continuation of application No. 17/463,990, filed on Sep. 1, 2021, now Pat. No. 12,145,774.

(51) Int. Cl.
*B65D 33/25* (2006.01)

(52) U.S. Cl.
CPC ..... *B65D 33/2541* (2013.01); *B65D 33/2584* (2020.05)

(58) Field of Classification Search
CPC ..... B65D 33/25; B65D 33/2508; B65D 33/2516; B65D 33/2525; B65D 33/2533; B65D 33/2541; B65D 33/255; B65D 33/2558; B65D 33/2566; B65D 33/2575; B65D 33/2583; B65D 33/2584; B65D 33/2585; B65D 33/2586; B65D 33/25865; B65D 33/2587; B65D 33/2588; B65D 33/2589; B65D 33/259; B65D 33/2591
USPC ..... 383/61.1, 63, 64, 65
See application file for complete search history.

(56) References Cited

U.S. PATENT DOCUMENTS

| | | | |
|---|---|---|---|
| 5,088,971 | A | 2/1992 | Herrington |
| 5,131,121 | A | 7/1992 | Herrington, Jr. et al. |
| 5,161,286 | A | 11/1992 | Herrington, Jr. et al. |
| 5,448,807 | A | 9/1995 | Herrington, Jr. |

(Continued)

FOREIGN PATENT DOCUMENTS

| | | | |
|---|---|---|---|
| CN | 104773359 | A | 7/2015 |
| CN | 107264960 | A | 10/2017 |

(Continued)

*Primary Examiner* — Nathan J Newhouse
*Assistant Examiner* — Nina K Attel
(74) *Attorney, Agent, or Firm* — Merchant & Gould P.C.

(57) ABSTRACT

A zipper closure includes mating first and second profiles, which releasably interlock along a parting line along the side. A slider can be used to open and close the slider. The slider has a channel, which receives an ear on the second profile, and the ear rides through the ear-receiving channel to align engaging structure of the first and second profiles and roll them together into interlocked engagement. The slider has a splitter on a deflectable tab, which can be pressed into a notch on the zipper closure to initially separate the mating profiles, while moving the slider to direct the ear into an ear-receiving channel in the slider and deflect the ear to a side and pry open and separate the profiles.

20 Claims, 10 Drawing Sheets

(56) References Cited

U.S. PATENT DOCUMENTS

| | | | |
|---|---|---|---|
| 5,871,281 | A | 2/1999 | Stolmeier et al. |
| 6,481,890 | B1 | 11/2002 | VandenHeuvel |
| 7,921,534 | B2 | 4/2011 | Patel et al. |
| 9,505,531 | B2 | 11/2016 | Chapek |
| 11,077,989 | B2 | 8/2021 | Derue et al. |
| 2003/0000050 | A1 | 1/2003 | Blythe |
| 2003/0185468 | A1 | 10/2003 | Keith et al. |
| 2006/0168779 | A1 | 8/2006 | Chaturvedi |
| 2011/0317942 | A1 | 12/2011 | Blythe et al. |

FOREIGN PATENT DOCUMENTS

| | | | |
|---|---|---|---|
| EP | 1312178 | A1 | 5/2003 |
| EP | 1391390 | A1 | 2/2004 |
| FR | 2770493 | A1 | 5/1999 |
| WO | 2012064688 | A2 | 5/2012 |

CHILD RESISTANT ZIPPER CLOSURE, SLIDER, RECLOSEABLE POUCH AND METHODS

CROSS-REFERENCE TO RELATED APPLICATION

This application is a continuation of U.S. patent application Ser. No. 17/463,990, filed Sep. 1, 2021, the disclosure of which is incorporated herein by reference in its entirety.

TECHNICAL FIELD

This disclosure relates to a zipper closure, a slider useable with the zipper closure, and a recloseable zipper pouch using the zipper closure and slider. More particularly, this disclosure relates to a zipper closure, slider, and recloseable zipper pouch that is child resistant.

BACKGROUND

Manufacturers of household products have increasingly replaced rigid packages with recloseable flexible packages due to the advantages offered by these flexible packages that include: less packaging material, lower package cost, reduced storage space, and lower shipping costs.

Once recloseable flexible packages containing household products are purchased, they are typically stored in a convenient household location where they are retrieved, opened, and reclosed until the contents are depleted. Opening and reclosing of these packages is easy for both adults and children. If these packages contain potentially harmful products and are accessible to young children, this presents a risk to them. As a result, there is a need to provide for a large scale closure and method to increase the difficulty for children to open the pouch and yet provide adequate means for adults and senior citizens to open the pouch.

Current child resistant closure systems are susceptible to entry (failure) by parting two halves of the closure profile with fingernails. Children can sometimes gain entry through the closure by using fingernails to separate the closure profiles. The children force their fingernails down on the top of the closure where there is a visible parting line. The force from the fingernails wedges the profiles apart, resulting in child resistance failure. Improvements are desired in which the use of fingernails cannot result in breach of the child resistance closure.

SUMMARY

In general, a zipper closure, slider, and recloseable zipper pouch are provided which improve the prior art.

In one aspect, a zipper closure is provided comprising a first profile having a first base and first engaging structure extending from the first base; and a second profile having a second base and second engaging structure extending from the second base, sized to releasably interlock with the first engaging structure. The first profile and second profile are constructed and arranged to releasably interlock along a parting line contained within a plane orthogonal to a plane containing the first base.

The first base preferably has a terminal end with a stub; and the second profile includes an ear extending from the second base and sized to rest on the stub, when the first profile and second profile are interlocked. The parting line is between and against the ear and the stub.

The first profile preferably is a female profile having a first base and a pair of spaced legs extending from the first base.

Preferably, the second profile is a male profile having a second base and a stem with a head extending from the second base and sized to be received within the legs of the female profile.

In example embodiments, each of the legs has hooked terminal ends.

Preferably, the ear extends from the second base at an angle of 70-100°.

In some example embodiments, the ear extends from the second base at an angle of 75-95°.

The pair of spaced legs preferable includes: a first leg having an end segment spaced from the first base and generally parallel to the first base; a first hook projecting from the end segment in a direction toward the first base; and a second leg having a second hook projecting from a terminal end of the second leg in a direction toward the first base.

In some embodiments, the head of the male profile includes an elongated head piece non-centered on the stem, dividing the head into a major head piece and minor head piece; the major head piece positioned to engage the first hook of the first leg; and the minor head piece positioned to engage the second hook of the second leg.

Preferably, the ear is spaced from and axially overlaps the second leg, when the male profile and female profile are interlocked.

In example embodiments, the zipper closure further includes a first attachment flange extending from the first profile; a second attachment flange extending from the second profile; and wherein the first and second attachment flanges are contained within planes generally parallel to the plane containing the first base.

In another aspect, a slider for a zipper closure having mating tracks with complementary profiles for interlocking and unlocking is provided. The slider comprises: (a) a top member, a bottom member, a first end wall, and a second end wall; and first and second legs extending from the bottom member at least partially toward the top member; (i) the top member of the slider adapted to move along upper edges of the tracks with the first and second legs straddling the tracks; (b) the top member having an open volume gap, free of other slider structure, and separating the top member between a first section and a second section; (i) the first section of the top member being adjacent to the first end wall; the first section having an inner surface at the first end wall facing the bottom member; a first part of the inner surface connected to and being within an inner surface plane orthogonal to the second leg; (ii) the second section of the top member being adjacent to the second end wall; (c) an ear-receiving channel recessed from the inner surface plane and defined by the first leg and the first section of the top member; the ear receiving channel including an opening in the first end wall and being laterally spaced from a central plane bisecting the slider, the central plane being orthogonal to the top member; (d) a splitter extending from the second section; the splitter being selectively moveable into a position to be between the mating tracks; and (e) the first and second legs having internal surfaces spaced sufficiently close together to press the profiles into interlocking relationship as the slider is moved in a closing direction along the zipper closure.

Preferably, the second section of the top member is spaced above the first and second legs such that there is a cavity of open volume in between the second section and the first and second legs. The second section is flexible from the second end wall in a direction toward and away from the first and second legs.

In one or more embodiments, the slider further includes an arm projecting from the first section of the top member such that the ear-receiving channel is defined by the arm, the first slider leg, and the first section of the top member.

In many examples, the ear-receiving channel includes a first groove wall and second groove wall in opposition to each other; the first groove wall being a part of the first leg, and the second groove wall being part of the arm.

Preferably, the ear-receiving channel is in open communication with the open volume gap of the top member.

In many examples, the splitter has a splitter base and an apex at end opposite of the splitter base.

In example embodiments, the splitter base is immediately adjacent to the open volume gap of the top member, and the apex points to the second end wall.

In some implementations, the first leg has a first shoulder at a terminal end, and the second leg has a second shoulder at a terminal end; the first shoulder and second shoulder being positioned to engage a bottom edge of the tracks.

In another aspect, a child resistant slider zipper closure system is provided. The system comprises (a) a reclosable zipper closure with mating tracks having complementary profiles for interlocking and unlocking; the zipper closure including (i) a first profile with a first base, first engaging structure extending from the first base, and a stub at a terminal end of the first base; (ii) a second profile having a second base and second engaging structure extending from the second base, sized to releasably interlock with the first engaging structure; the second profile including an ear extending from the second base and sized to rest on the stub, when the first and second profiles are interlocked; a parting line between the first and second profiles being between and against the ear and the stub; (b) a slider being slidably located on the zipper closure; the slider including a top member, a bottom member, a first end wall, and first and second legs extending from the bottom member at least partially toward the top member; (i) the top member of the slider adapted to move along upper edges of the tracks with the first and second legs straddling the tracks in a closing direction, interlocking the tracks; and in an opening direction, unlocking the tracks; (ii) the slider including an ear-receiving channel defined by the first leg and the top member; the ear receiving channel including an opening in the first end wall and being laterally spaced from a central plane bisecting the slider, the central plane being orthogonal to the top member; and wherein when the slider is moved in the closing direction, the ear of the second profile slides through the ear-receiving channel to align the second engaging structure with the first engaging structure to interlock the first and second profiles together.

In preferred implementations, the slider further includes a splitter extending from the top member; a notch is defined by the complementary profiles; the notch being spaced from an end of the slider zipper closure system; and when the splitter is engaged with the notch, the splitter holds the ear of the second profile to guide the ear into the ear-receiving channel to retain the ear in an opening position while moving the slider in the opening directing to separate the profiles.

Preferably, the slider further includes: (a) a second end wall; (b) the top member having an open volume gap, free of other slider structure, and separating the top member between a first section and a second section; (i) the first section of the top member being adjacent to the first end wall; the first section having an inner surface at the first end wall facing the bottom member; a first part of the inner surface connected to and being within an inner surface plane orthogonal to the second leg; (ii) the second section of the top member being adjacent to the second end wall; (c) the ear-receiving channel being recessed from the inner surface plane; (d) the splitter extending from the second section of the top member; and (c) the first and second legs having internal surfaces spaced sufficiently close together to press the profiles into interlocking relationship as the slider is moved in the closing direction along the zipper closure.

In many example embodiments, the slider further includes an arm projecting from the first section of the top member such that the ear-receiving channel is defined by the arm, the first slider leg, and the first section of the top member.

The second section of the top member is preferably spaced above the first and second slider legs of the base such that there is a cavity of open volume in between the second section and the first and second slider legs.

In preferred examples, the parting line of the zipper closure is contained within a plane orthogonal to a plane containing the first base.

In example implementations, the system further includes: (a) a first attachment flange extending from the first profile; (b) a second attachment flange extending from the second profile; and wherein the first and second attachment flanges are contained within planes generally parallel to the plane containing the first base.

In preferred examples, a flexible package using the slider zipper closure system, as characterized above, is provided comprising: (a) first and second panels each having a top forming a mouth, a bottom, and first and second opposing sides, the first and second panels being joined to each other along their respective bottoms, their respective first opposing sides, and their respective second opposing sides; and (b) wherein the first attachment flange is secured to the top of the first panel; and the second attachment flange is secured to the top of the second panel.

In another aspect, a method of operating a zippered bag having an openable and recloseable mouth is provided. The method comprises (a) providing a zippered bag having first and second panels each having a top forming the mouth, a bottom, and first and second opposing sides, the first and second panels being joined to each other along their respective bottoms, their respective first opposing sides, and their respective second opposing sides; a recloseable zipper closure including mating tracks with complementary profiles for interlocking and unlocking; one profile being in proximity to the top of the first panel, and the other profile being in proximity to the top of the second panel; the complementary profiles interlocking to close the mouth and unlocking to open the mouth; the zipper closure including a notch spaced from the first side; a slider located on the zipper closure; the zipper closure including, (i) a first profile with a first base, first engaging structure extending from the first base, and a stub at a terminal end of the first base; (ii) a second profile having a second base and second engaging structure extending from the second base, sized to releasably interlock with the first engaging structure; (A) the second profile including an ear extending from the second base and sized to rest on the stub, when the first and second profiles are interlocked; (B) a parting line between the first and second profiles being between and against the ear and the stub; and (b) opening the mouth by: (i) moving the slider to the notch; (ii) pressing down on a flexible tab on the slider to position a splitter on the tab between the mating tracks; (iii) moving the slider to direct the ear into an ear-receiving channel in the slider; and (iv) moving the slider in an opening direction along the zipper closure to deflect the ear to a side and pry open and separate the first profile and second profile to result in separation of the interlocking profiles.

The method preferably includes a step of closing the mouth by moving the slider in a closing direction, opposite of the opening position, while having the ear ride through the ear-receiving channel to align a second engaging structure of the second profile into a receiving volume of first engaging structure of the first profile and rolling the first and second profiles together into interlocked engagement.

In one or more examples, the step of moving the slider includes aligning a stem of the second profile into the receiving volume between legs of the first profile.

A variety of examples of desirable product features or methods are set forth in part in the description that follows, and in part will be apparent from the description, or may be learned by practicing various aspects of this disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Figure 2:
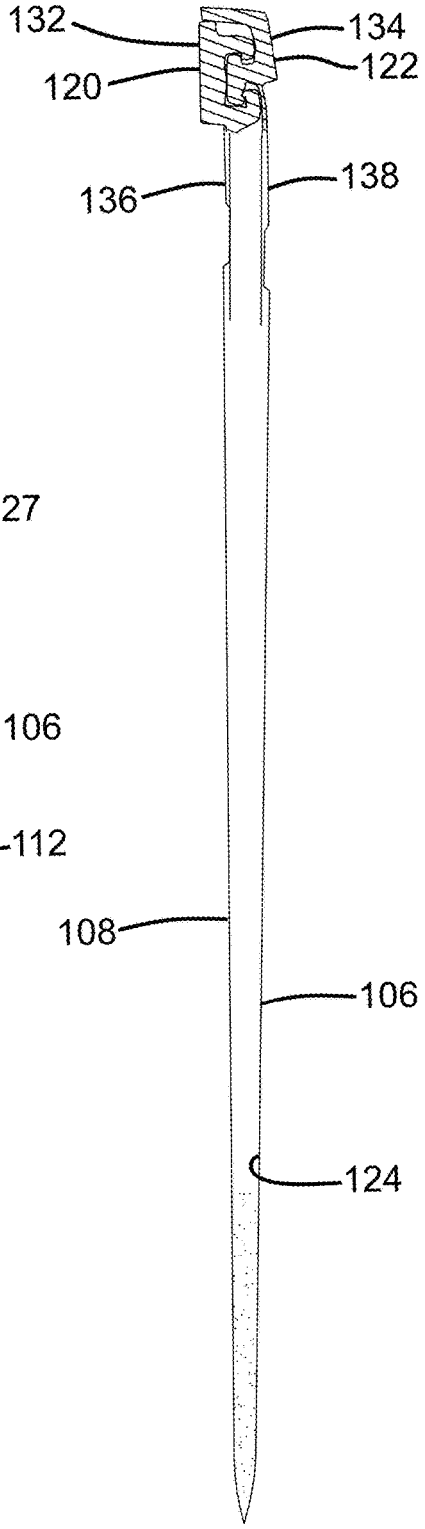
FIG. 2 is a cross-sectional view of the bag with recloseable zipper closure of FIG. 1, the cross-section being taken along the line 2-2 of FIG. 1.
Figure 1:
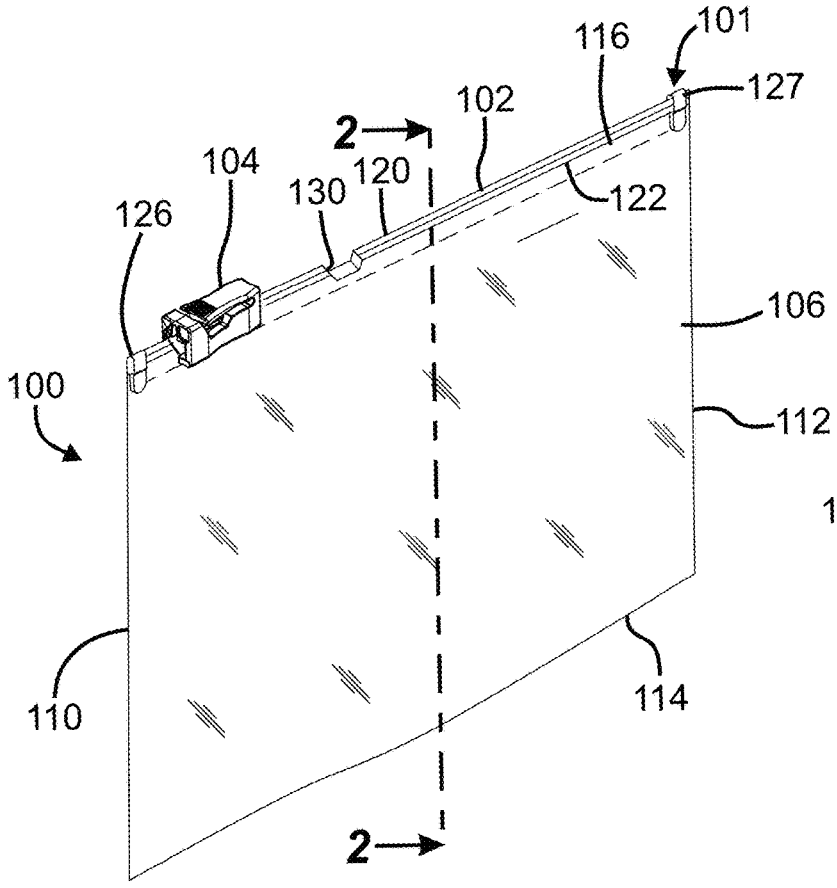
FIG. 1 is a schematic perspective view of an example embodiment of a bag with a recloseable zipper closure and slider, constructed in accordance with principles of this disclosure.

In reference first to FIGS. 1 and 2, a recloseable pouch/flexible package, e.g. bag, is shown at 100. The bag 100 has a recloseable zipper closure system 101 having a recloseable zipper closure 102. The zipper closure 102 includes child resistant opening features to inhibit a child from easily being able to open the zipper closure 102.

In particular, zipper closure system 101 includes slider 104 with child resistant features. More details on the slider 104 are discussed further below.

In the example embodiment, the bag 100 can be made in many different ways. In the non-limiting example shown, the bag 100 is formed from a single flexible plastic sheet folded upon itself, and includes first and second opposing body panels 106 and 108. Body panels 106, 108 are fixedly connected to each other along a pair of sides 110, 112 and a bottom 114 which extends between the sides 110, 112. The flexible plastic sheet can be made from a variety of materials, including a polymeric material.

The bag 100 preferably has the zipper closure 102 extending along a mouth 116 formed opposite the bottom 114 of bag 100, in which the zipper closure 102 has complementary profiles for interlocking and unlocking. In one example, the complementary profiles include opposite mating tracks 120, 122. An interior volume 124 of the bag 100 is accessible through the mouth 116, when the zipper closure 102 is unlocked in an open position.

The opposite ends of the zipper closure 102 are provided with ends of the profiles forming raised sections or end stops 126 and 127, which can be ultrasonically welded or made by other ways. These raised sections/end stops 126, 127 prevent the slider 104 from being easily pulled off of the ends of the zipper closure. Many variations are possible. For example, end stops can be made according to any of U.S. Pat. Nos. 7,921,534; 5,088,971; 5,131,121; 5,161,286; and 5,448,807, each of which is incorporated herein by reference in its entirety.

Figure 9:
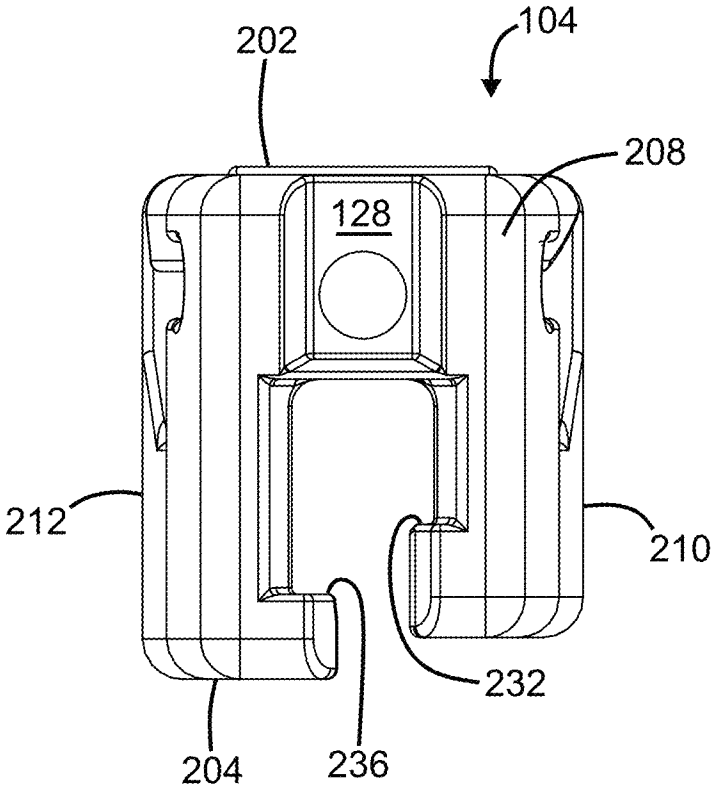
FIG. 9 is an opposite end view of the slider of FIG. 8.

The slider 104 is illustrated herein with optional engagement pockets 128, 129 (FIGS. 8 and 9) positioned inboard of the terminal ends of the slider 104. The engagement pockets 128, 129 receive within and strike a respective one of the end stops 126, 127. The engagement pockets 128, 129 can be constructed according to U.S. Pat. No. 11,077,989, incorporated herein by reference.

In reference again to FIG. 1, the slider 104 is shown parked at a distance from side 110 of the bag 100. In this position, the zipper closure 102 is closed, with the mating tracks 120, 122 interlocked. The zipper closure 102 includes a notch 130 spaced from the side 110 of the bag 100. The distance will be such that the slider 104 must be moved from its parked position to find the notch 130. For example, this can be about one-fourth down the length of the zipper closure 102. The purpose of the notch 130 is discussed further below, in conjunction with operation of the slider 104.

As shown in FIG. 2, tracks 120, 122 have interlocking first and second profiles 132, 134 extending the length thereof. The tracks 120, 122 may be extruded separately with a fin or flange 136, 138 and attached to the respective sides 110, 112, or may be extruded integrally with the sides 110, 112. If the tracks 120, 122 are extruded separately, they are attachable by the flanges 136, 138 heat sealed to the bag 100. The first and second profiles 132, 134 have complementary cross-sectional shapes and are closed by pressing a bottom of the profiles 132, 134 together first and then rolling to a closed position toward the top thereof.

Figure 4:
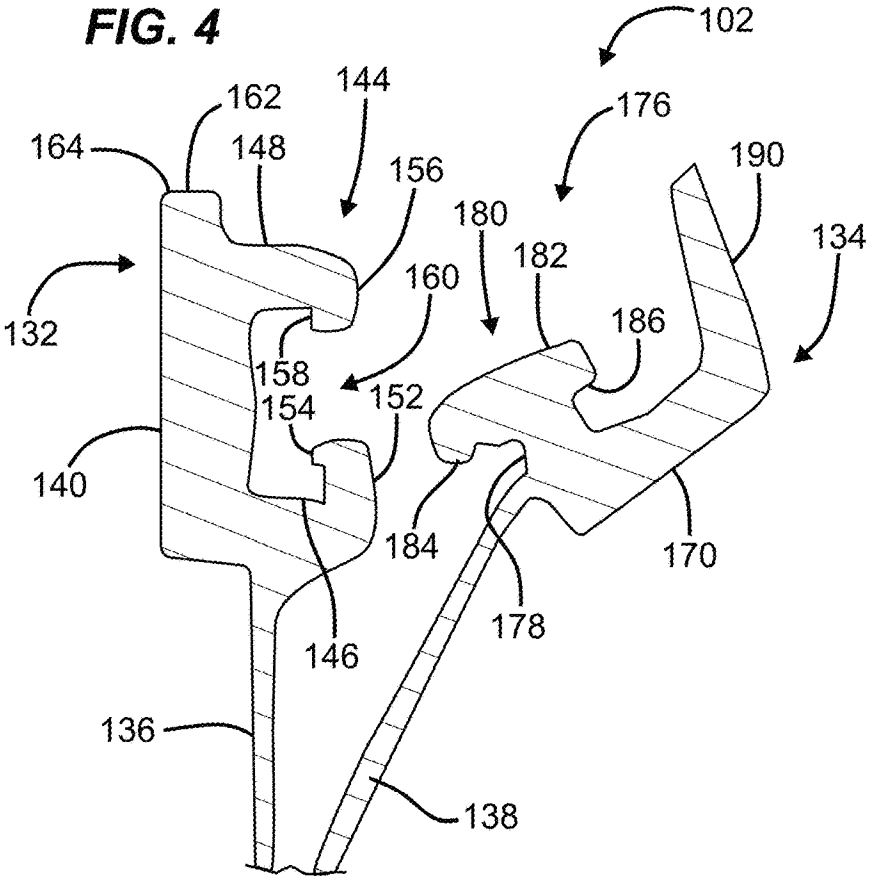
FIG. 4 is the zipper closure of FIG. 3 in an unlocked position.
Figure 3:
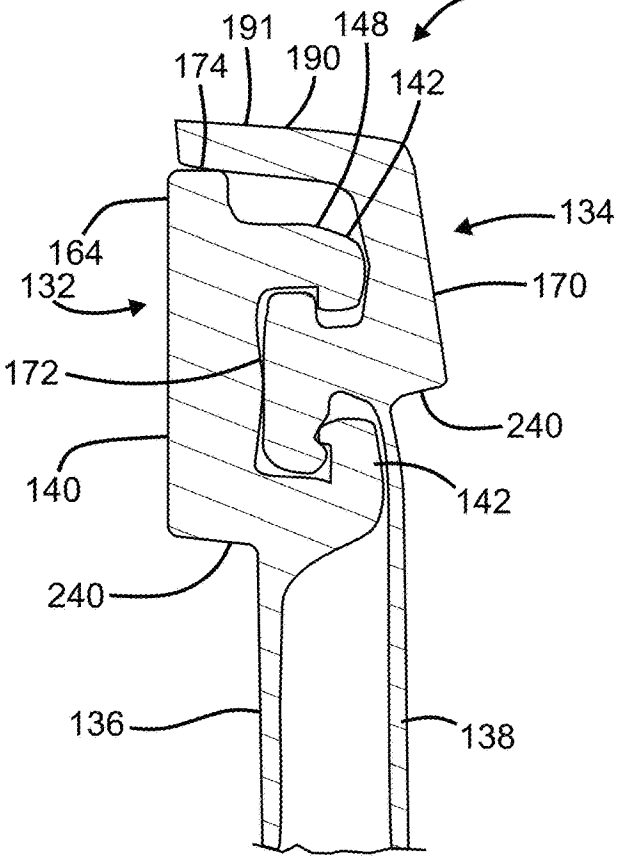
FIG. 3 is a cross-sectional view of the zipper closure of FIG. 2, in an interlocked position.

In reference now to FIGS. 3 and 4, a close up example of the zipper closure 102 is shown. FIG. 3 shows the zipper closure 102 engaged or interlocked, while FIG. 4 shows the zipper closure 102 released, disengaged, or unlocked.

In the example shown, the first profile 132 has a first base 140 and first engaging structure 142 extending from the first base 140. In some implementations, the first engaging structure 142 could be considered a female profile 144 having a first leg 146 spaced from a second leg 148 extending from the first base 140.

Many different configurations are possible. In the example shown, the first leg 146 has an end segment 152 spaced from the first base 140 generally parallel to the first base 140. A first hook 154 projects from the end segment 152 at a terminal end in a direction toward the first base 140.

The second leg 148 has an end segment 156 spaced from the first base 140 generally parallel to the first base 140. A second hook 158 projects from the end segment 156 at a terminal end in a direction toward the first base 140.

The spaced first leg 146 and second leg 148 define a receiving volume 160 therebetween. The receiving volume 160 is sized to receive and releasably interlock with the second profile 134.

In accordance with principles of this disclosure, the first base 140 has a terminal end 162 with a stub 164. The stub 164 forms the terminal end 162 of the first base 140 and is out of alignment with a longitudinal axis along the second leg 148.

As can be seen in FIGS. 3 and 4, the first attachment flange 136 extends from the first profile 132. In the example embodiment shown, the first attachment flange 136 is generally parallel to the first base 140.

Still in reference to FIGS. 3 and 4, the second profile 134 has a second base 170 and second engaging structure 172 extending from the second base 170, sized to releasably interlock with the first engaging structure 142. The first profile 132 and second profile 134 are constructed and arranged to releasably interlock along a parting line 174 contained within a plane orthogonal to a plane containing the first base 140.

In some implementations, the second profile 134 can be considered to be a male profile 176. A stem 178 having a head 180 extends from the second base 170 and is sized to be received within the receiving volume 160 of the legs 146, 148 of the first profile 132.

Many configurations are possible. In the example shown, the head 180 of the male profile 176 includes an elongated head piece 182 non-centered on the stem 178, dividing the head 180 into a major head piece 184 and minor head piece 186. The major head piece 184 is positioned to engage the first hook 154 of the first leg 146. The minor head piece 186 is positioned to engage the second hook 158 of the second leg 148.

In the example shown, the second attachment flange 138 extends from the second profile 134. As shown in the examples, the first and second attachment flanges 136, 138 are contained within planes generally parallel to the plane containing the first base 140, when the profiles 132, 134 are interlocked (FIG. 3).

In accordance with principles of this disclosure, the second profile 134 includes an ear 190. As shown in the example embodiment, the ear 190 extends from the second base 170. The ear 190 is preferably sized to rest on the stub 164, when the first profile 132 and second profile 134 are interlocked.

In FIG. 3, it can be seen that, preferably, the parting line 174 is between and against the ear 190 and the stub 164. The parting line 174 is formed along the side of the closure 102 rather than directly along the top. This location of the parting line 174 helps to hide it from children and anyone without prior knowledge of the geometry of the closure 102.

The ear 190 extends from the second base 170 at an angle of 70-100°, more preferably, at an angle of 75-95°. As can be seen in FIG. 3, when the male profile 176 and female profile 144 are interlocked, the ear 190 is spaced from and axially overlaps the second leg 148. The ear 190 engages against the stub 164.

In the preferred arrangement, the interface of the first profile stub 164 and second profile ear 190 is tight. The tightness creates difficulty to wedge the profiles 132, 134 apart. The overlap between the profiles 132, 134 makes it difficult to pry open the profiles 132, 134 even if a fingernail separates the parting line 174. As explained further below, the slider 104 accommodates the ear 190 and provides sufficient movement to separate the profiles 132, 134 when the slider 104 is engaged in separation action.

If a fingernail does access the parting line 174, the force to separate the parting line 174 wedges the male profile 176 up and the female profile 144 down. The lifting up of the ear 190 and the pushing down of the stub 164 pulls the locking elements (i.e., first engaging structure 142 and second engaging structure 172) together tighter and increases the lock overlap, specifically between the minor head piece 186 and the second hook 158 of the second leg 148. This up/down levering increases the force necessary to separate the male profile 176 and female profile 144 and enhances fingernail resistance. If a small child gained access to the side parting line 174 by using a fingernail and tried to separate the profiles 132 and 134, the child would face the challenge of a tightening lock of the profiles 144, 176. To overcome the lock, the child would need adult finger force exerting a rolling action on the profiles 144, 176 away from each other.

In reference now to FIGS. 6-15, an example embodiment of the slider 104 for use for interlocking and separating (unlocking) the zipper closure 102 is illustrated. The slider 104 is preferably a non-metal, single-piece molded plastic material, but alternatives are possible.

The slider 104 includes a top member 202, a bottom member 204, a first end wall 206, and a second end wall 208. First slider leg 210 and second slider leg 212 extends from the bottom member 204 at least partially toward the top member 202.

In use, the top member 202 is adapted to move along upper edges of the tracks 120, 122 with the first and second legs 210, 212 straddling the tracks 120, 122. In this embodiment, the top member 202 moves along on top of the external outside facing surface 191 (FIG. 3) of the ear 190.

The top member 202 has an open volume gap 218, free of other slider structure, and separating the top member 202 between a first section 222 and a second section 224. The first section 222 of the top member 202 is adjacent to the first end wall 206. The second section 224 of the top member 202 extends between the gap 218 and the second end wall 208 and is adjacent to the second end wall 208.

Figure 8:
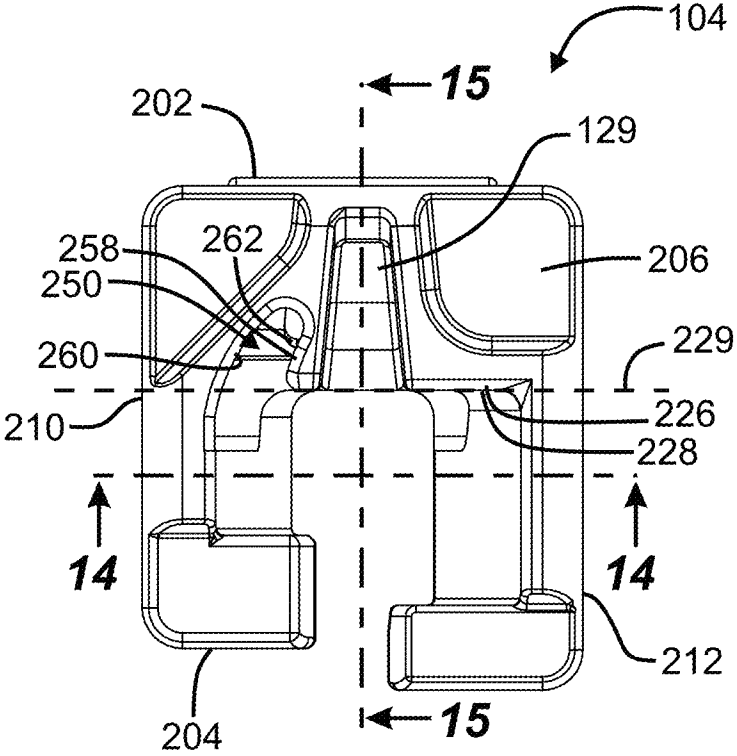
FIG. 8 is an end view of the slider of FIG. 6.
Figure 10:
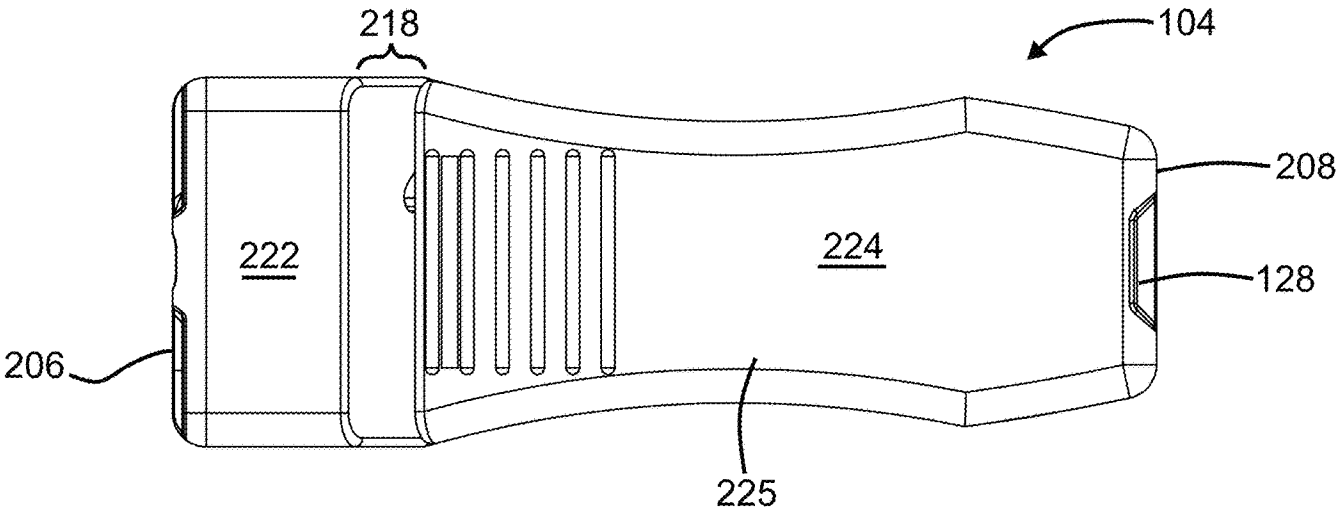
FIG. 10 is a top plan view of the slider of FIG. 6.
Figure 11:
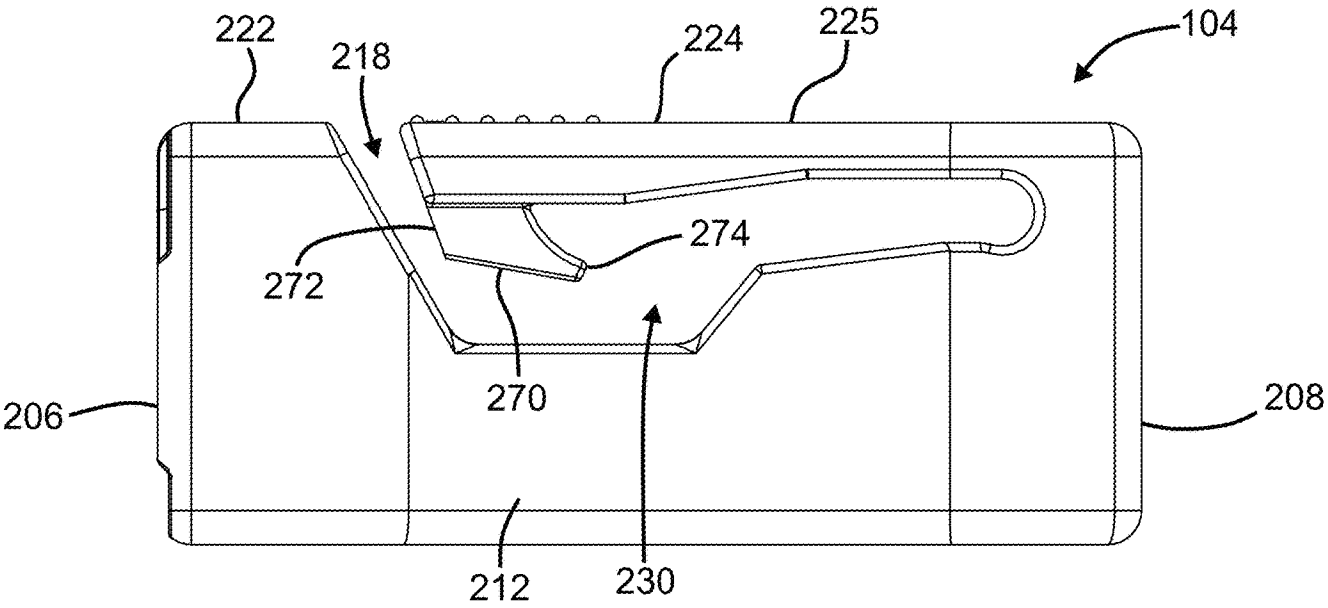
FIG. 11 is a side elevational view of the slider of FIG. 6.
Figure 12:
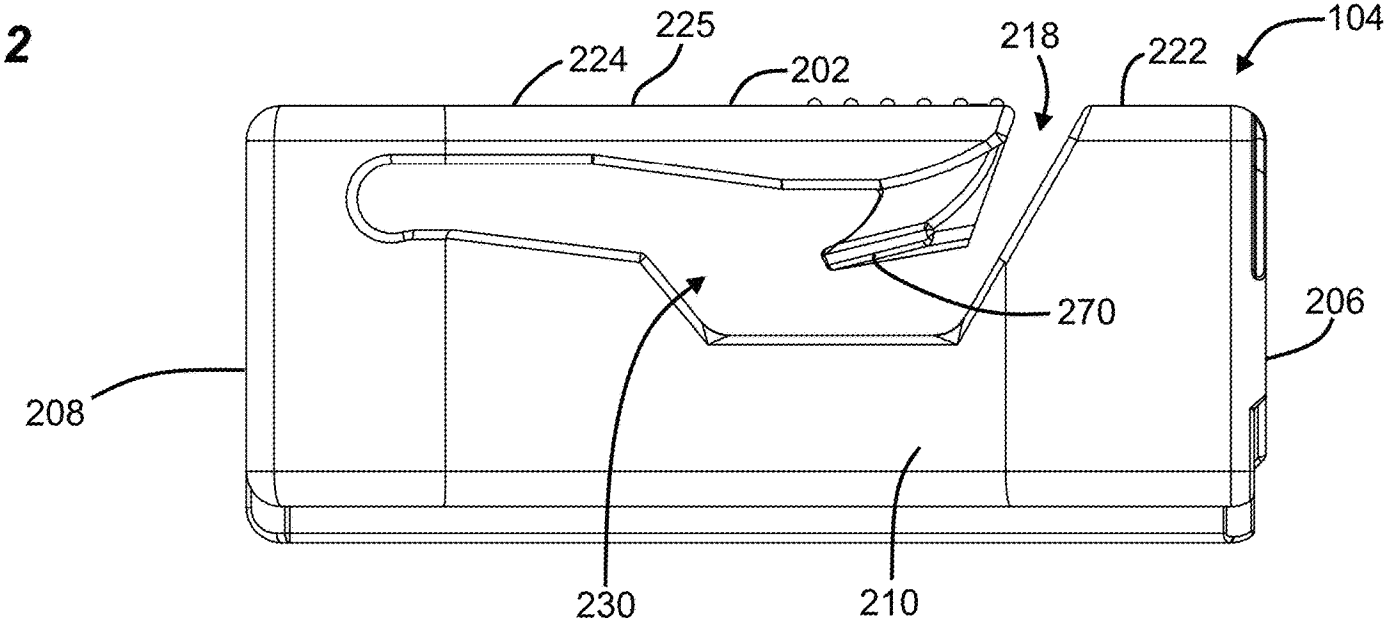
FIG. 12 is a side elevational view of the opposite side of the slider of FIG. 11.
Figure 13:
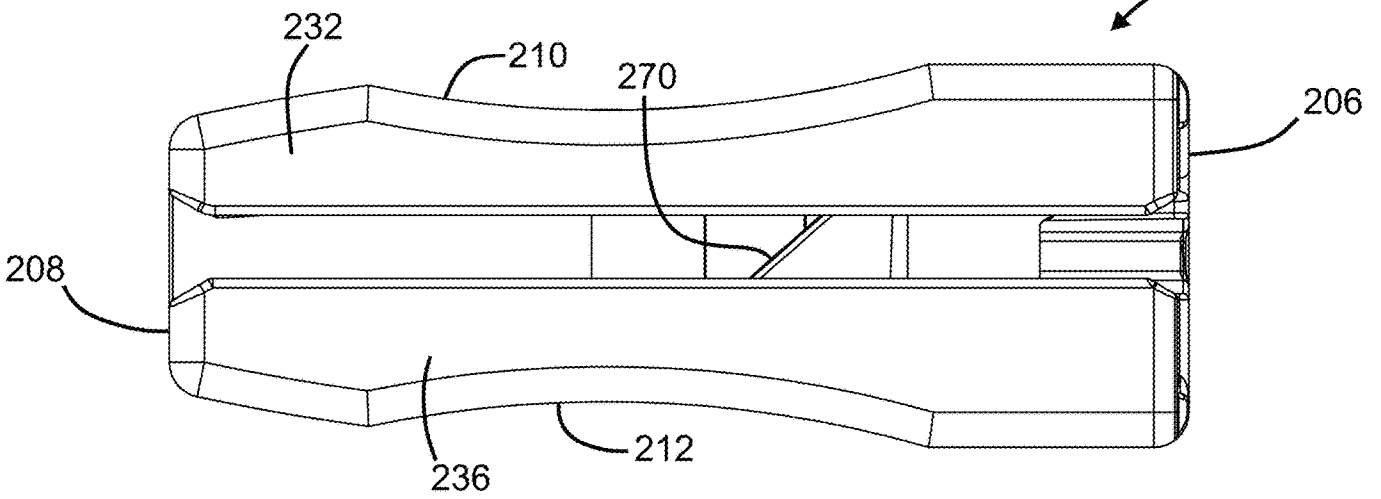
FIG. 13 a bottom plan view of the slider of FIG. 6.
Figure 14:
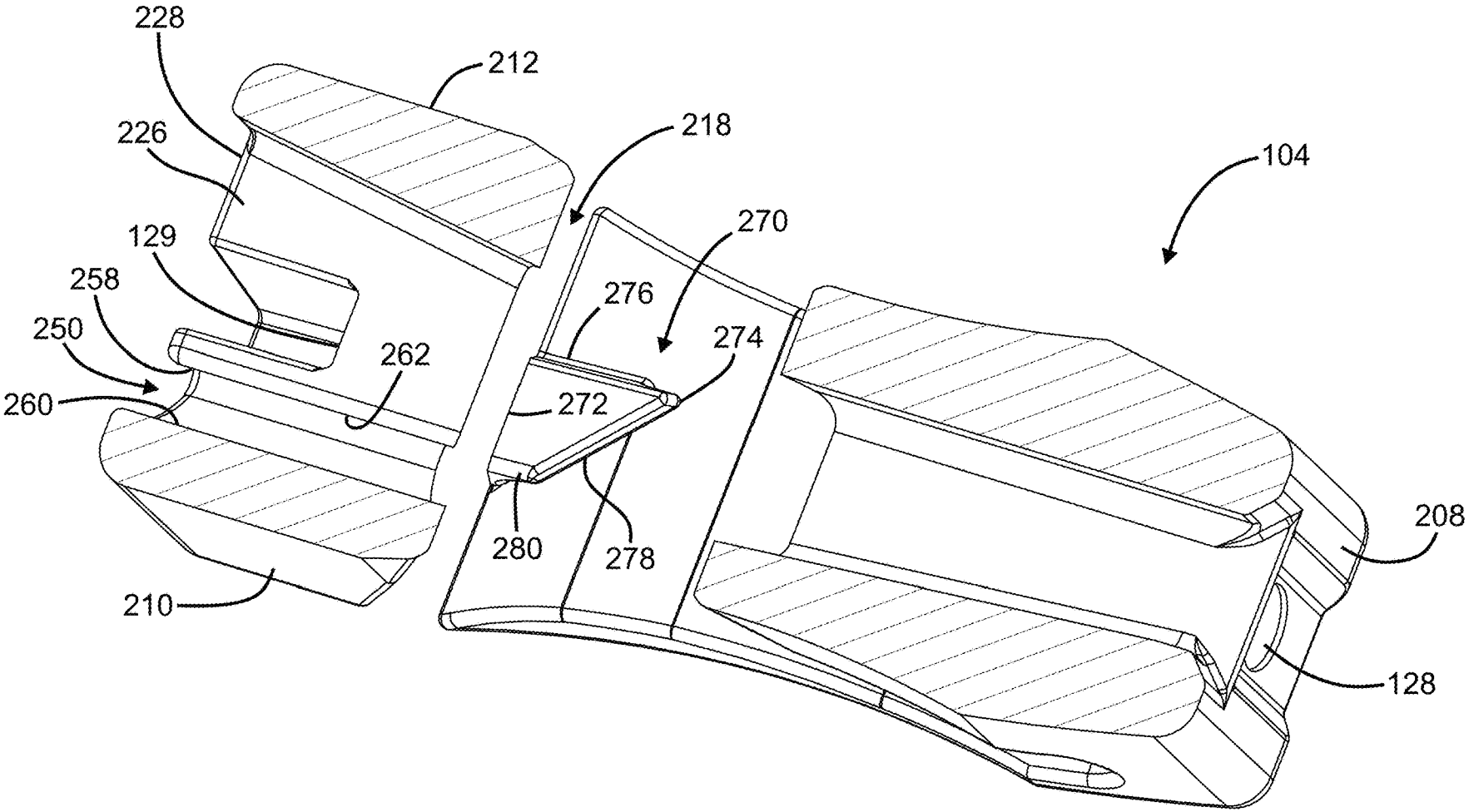
FIG. 14 is a cross-sectional view of the slider of FIG. 6, the cross-section being taken along the line 14-14 of FIG. 8.

In reference now to FIGS. 8 and 14, the first section 222 has an inner surface 226 at the first end wall 206 facing the bottom member 204. A first part 228 of the inner surface 226 is connected to the second leg 212; the first part 228 is also within an inner surface plane 229 that is orthogonal to the second leg 212.

Figure 5:
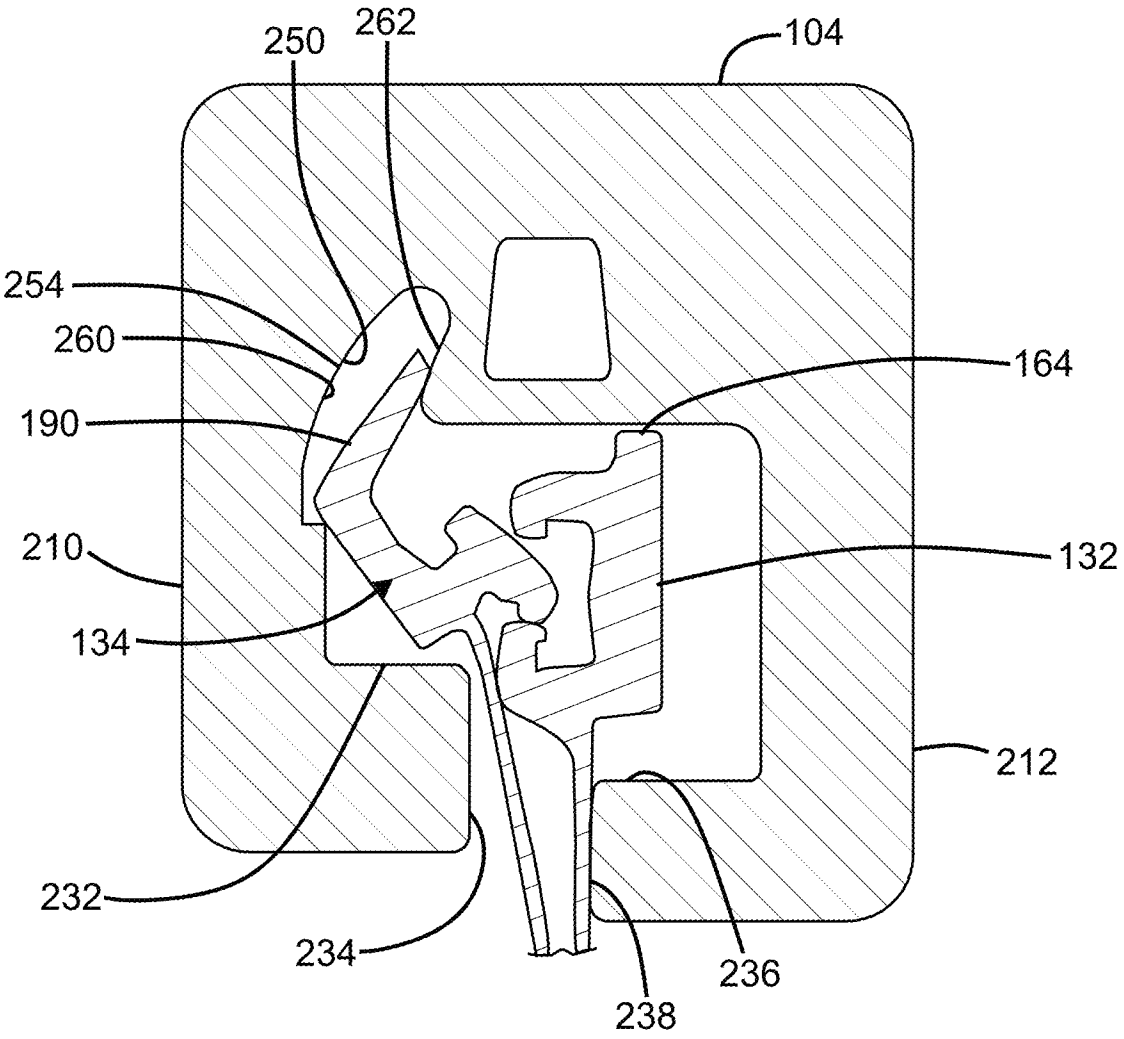
FIG. 5 is a cross-sectional view of the zipper closure of FIG. 3 with the slider of FIG. 1 and showing the slider unlocking the zipper closure.
Figure 6:
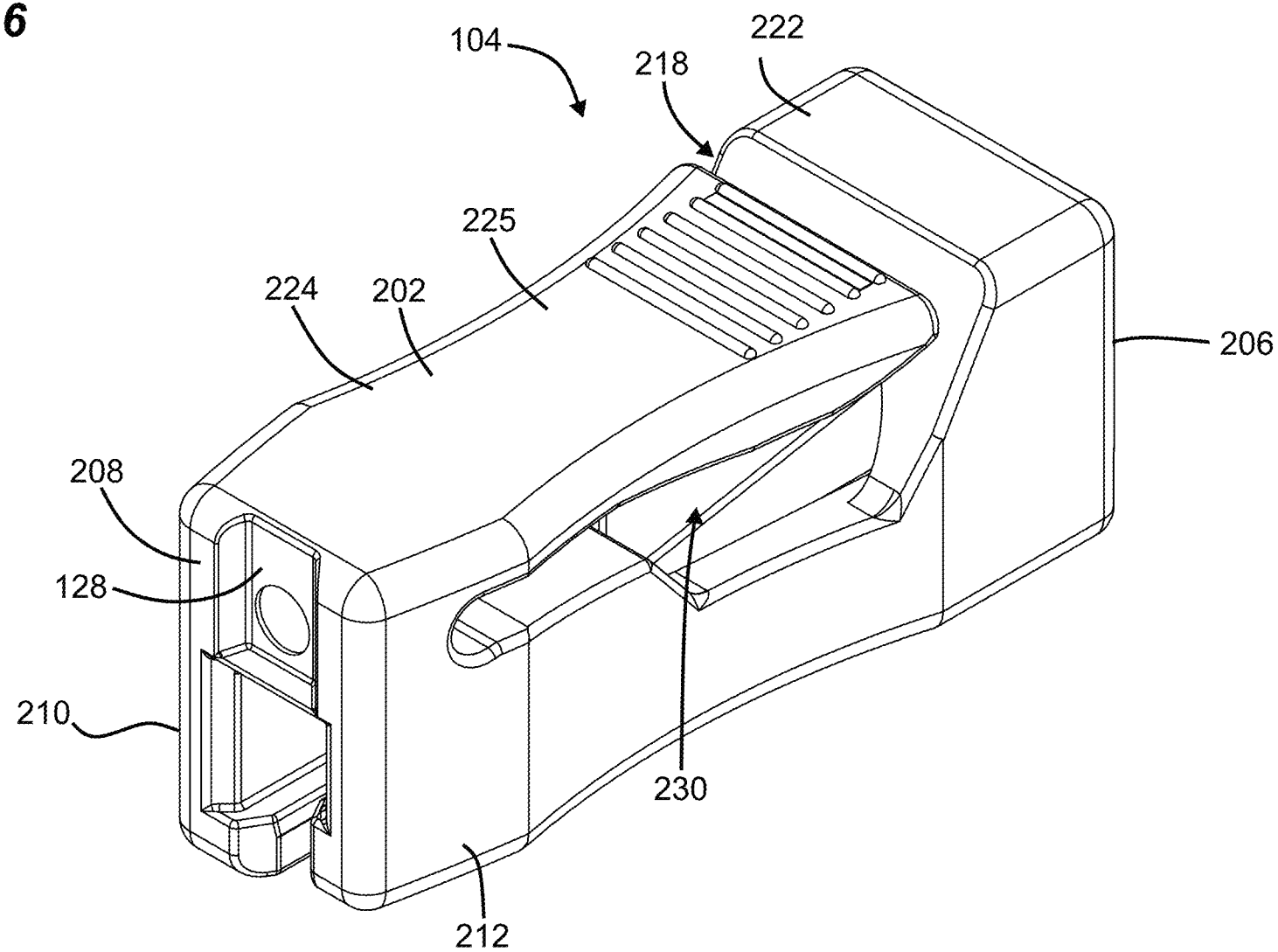
FIG. 6 is a perspective view of the slider of FIG. 1.
Figure 7:
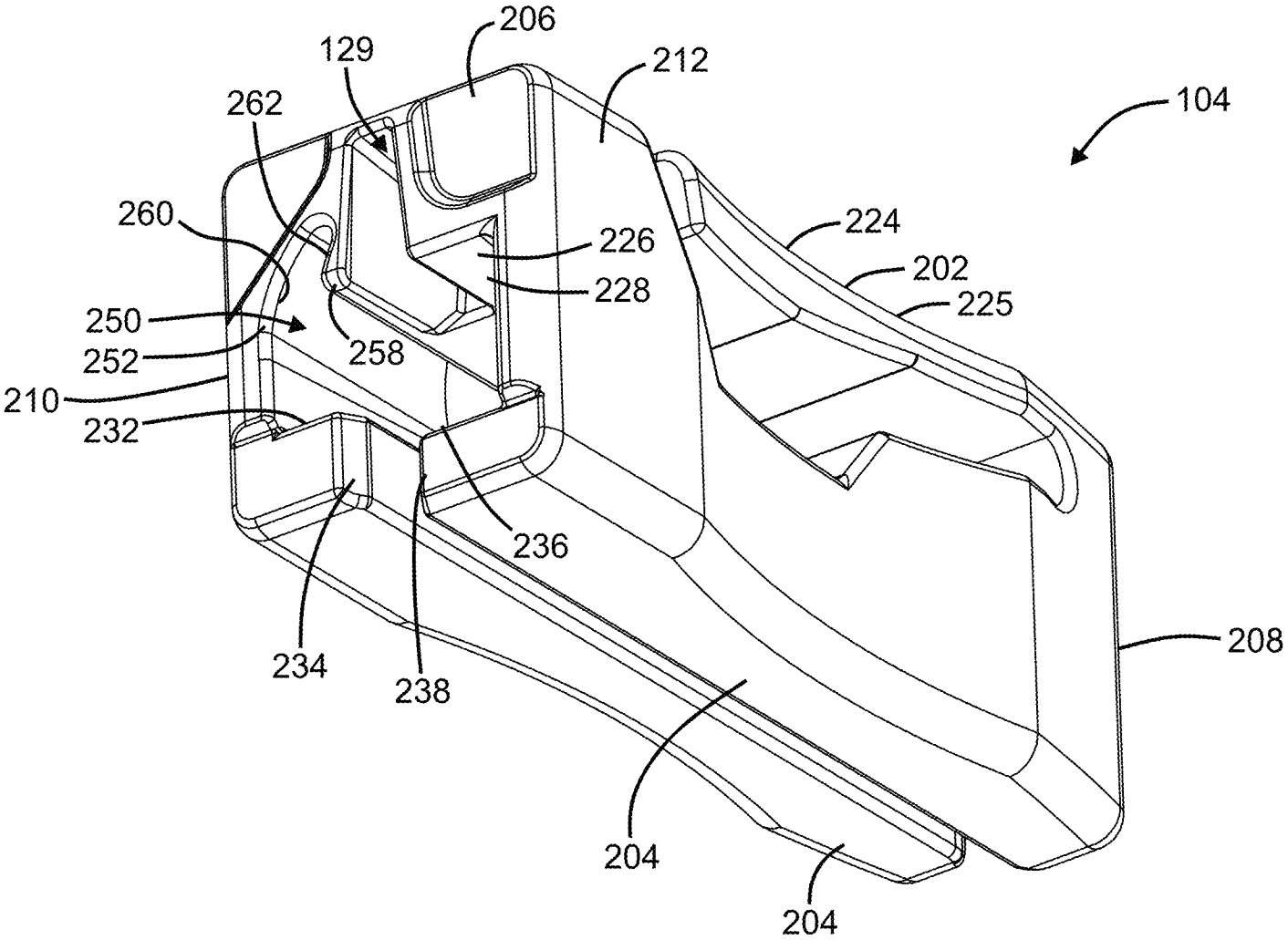
FIG. 7 is another perspective view of the slider of FIG. 1.

As can be seen in FIG. 5, the first and second legs 210, 212 have internal surfaces spaced sufficiently close together to press the profiles 132, 134 into interlocking relationship as the slider 104 is moved in a closing direction along the zipper closure 102, by pressing a bottom of the profiles 132, 134 together first and then rolling to a closed position toward the top thereof.

In this embodiment, the second section 224 of the top member 202 is spaced above the first and second legs 210, 212 of the bottom member 204 such that there is a cavity 230 (FIGS. 11 & 12) of open volume in between the second section 224 and the first and second legs 210, 212. The second section 224 is cantilevered from the second end wall 208 to form a flexible tab 225. The second section 224 is flexible or deflectable from the second end wall 208 and flexes or pivots in a direction toward and away from the first and second legs 210, 212.

Many embodiments are possible. In the arrangement shown, the first leg 210 has a first shoulder 232 at a terminal end 234, and the second leg 212 has a second shoulder 236 at a terminal end 238. The first shoulder 232 and second shoulder 236 are positioned to engage a bottom edge 240 (FIG. 3) of the tracks 120, 122.

In accordance with principles of this disclosure, the slider 104 includes an ear-receiving channel 250. The ear-receiving channel 250 is recessed from the inner surface plane 229 (FIG. 8) and is defined by the first leg 210 and the first section 222 of the top member 202. The ear-receiving channel 250 is constructed and arranged to receive the ear 190 and deflect the ear 190 to the side and pry open the first profile 132 and second profile 134 when moving the slider 104 along the closure 102 in an opening or unlocking direction.

In this embodiment, the ear receiving channel 250 includes an opening 252 in the first end wall 206 and is laterally spaced from a central plane bisecting the slider 104, the central plane being orthogonal to the top member 202.

Preferably, the ear-receiving channel 250 includes an arm 258 projecting from the inner surface of the first section 222 of the top member 202 such that the ear-receiving channel 250 is defined by the arm 258, the first slider leg 210, and the first section 222 of the top member 202.

In FIG. 8, it can be seen how the ear-receiving channel 250 includes a first groove wall 260 and second groove wall 262 in opposition to each other. The first groove wall 260 is being a part of the first leg 210, and the second groove wall 262 being part of the arm 258. The first groove wall 260 is illustrated as having an optional curved surface 254 (FIG. 5) extending from the first leg 210 to the first section 222 of the top member 202. In other embodiments, the curved surface 254 can be non-curved with straight segments.

Figure 15:
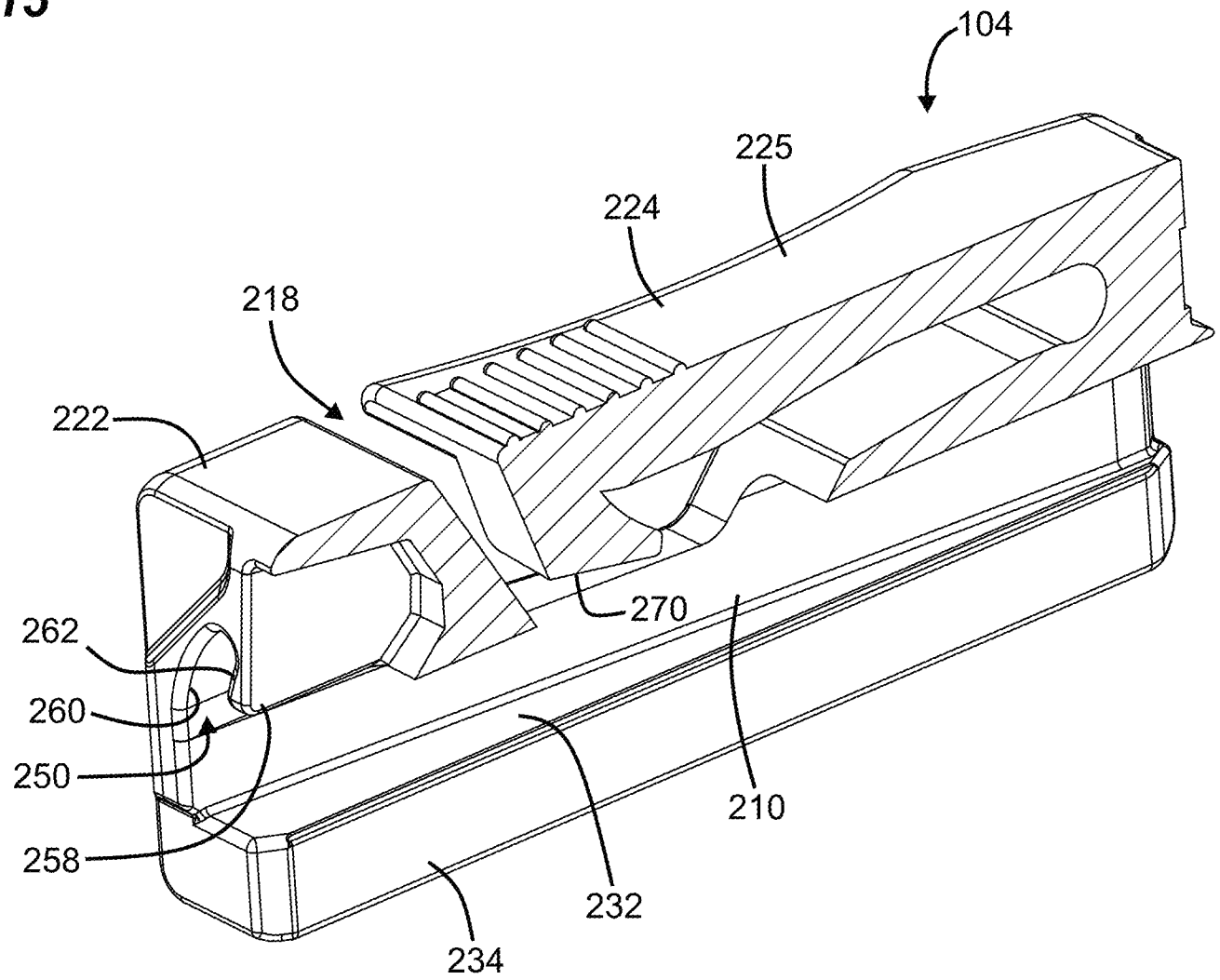
FIG. 15 is a cross-sectional view of the slider of FIG. 6, the cross-section being taken along the line 15-15 of FIG. 8.

As can be appreciated by reviewing FIGS. 14 and 15, the ear-receiving channel 250 is in open communication with the open volume gap 218 of the top member 202.

In accordance with principles of this disclosure, the slider 104 includes a plow/torpedo/or splitter 270. The splitter 270 extends from the second section 224 and faces down in a direction toward the shoulders 232, 236 of the legs 210, 212. The splitter 270 is selectively moveable into a position to be between the mating tracks 120, 122.

For example, to open the closure 102, a person would move the slider 104 to the notch 130 (FIG. 1) and apply downward pressure on the flexible tab 225, formed by the second section 224 of the top member 202, flexing the second section 224 into the cavity 230. The splitter 270 is then moved between the mating tracks 120, 122, while the ear-receiving channel 250 receives the ear 190 and deflects the ear 190 to the side and pry open and separate the first profile 132 and second profile 134, when moving the slider 104 along the closure 102 in an opening or unlocking direction.

The closure 102 is reclosed by sliding the slider 104 in the reverse direction. The ear 190 rides through the ear-receiving channel 250 which aligns the stem 178 of the second profile 134 to the receiving volume 160 between the legs 146, 148 of the first profile 132 by rolling the profiles 132, 134 together from bottom to top, as shown in FIG. 5.

Attention is directed to FIG. 14. An example embodiment of the splitter 270 is shown. There can be many variations, and this is just one illustrated example. In the example shown, the splitter 270 has a splitter base 272 and an apex 274 at end opposite of the splitter base 272. The splitter base 272 is immediately adjacent to the open volume gap 218 of the top member 202, and the apex 274 points to the second end wall 208. Forming the apex 274 is the intersection of side 276, 278 with an acute angle therebetween. The side 276 is generally orthogonal to the base 272 and adjacent to the open volume gap 218. The side 278 extends from the apex 274 to side 280. Side 280 is generally orthogonal to the base 272 and adjacent to the open volume gap 218. The side 280 has a length less than half of the length of the side 276. An obtuse angle extends between side 280 and side 278. The side 280 is closer to the first leg 210 than the second leg 212. Many alternatives are possible.

The above can be used in a method of operating a zippered bag having an openable and reclosable mouth 116, such as the bag 100 of FIG. 1.

The method includes opening the mouth 116 by: moving the slider 104 to the notch 130; pressing down on flexible tab 225 on the slider 104 to position splitter 270 on the tab 225 between the mating tracks 120, 122; moving the slider 104 to direct the ear 190 into ear-receiving channel 250 in the slider 104; and moving the slider 104 in an opening direction along the zipper closure 102 to deflect the ear 190 to a side and pry open and separate the first profile 132 and second profile 134 to result in separation of the interlocking profiles.

The method can include a step of closing the mouth 116 by: moving the slider 104 in a closing direction, opposite of the opening position, while having the ear 190 ride through the ear-receiving channel 250 to align second engaging structure 172 of the second profile 134 into receiving volume 160 of first engaging structure 142 of the first profile 132 and rolling the first and second profiles 132, 134 together into interlocked engagement.

The step of moving the slider 104 includes aligning stem 178 of the second profile 134 into the receiving volume between legs 146, 148 of the first profile 132.

The above represents example principles. Many embodiments can be made using these principles.

What is claimed is:

1. A zipper closure comprising:

(a) a first profile having a first base and first engaging structure extending from the first base; the first base having a stub defining a free terminal end surface at an uppermost portion of the first base;

(b) a second profile having a second base and second engaging structure extending from the second base, sized to releasably interlock with the first engaging structure;

(c) the second profile having an ear extending from the second base and sized to rest on the free terminal end surface of the stub;

(i) the ear extending from the second base at an angle of 70-100°; and wherein the first profile and second profile are constructed and arranged to be engaged along a parting line between and against the ear and the stub.

2. The zipper closure of claim 1 wherein the first profile is a female profile having the first base and a pair of spaced legs extending from the first base.

3. The zipper closure of claim 2 wherein the second profile is a male profile having the second base and a stem with a head extending from the second base and sized to be received within the legs of the female profile.

4. The zipper closure of claim 3 wherein each of the legs has hooked terminal ends.

5. The zipper closure of claim 3 wherein the pair of spaced legs includes:

(a) a first leg having an end segment spaced from the first base; a first hook projecting from the end segment in a direction toward the first base; and (b) a second leg having a second hook projecting from a terminal end of the second leg in a direction toward the first base.

6. The zipper closure of claim 5 wherein the head of the male profile includes an elongated head piece non-centered on the stem, dividing the head into a major head piece and minor head piece; the major head piece positioned to engage the first hook of the first leg; the minor head piece positioned to engage the second hook of the second leg.

7. The zipper closure of claim 6 wherein the ear is spaced from and axially overlaps the second leg, when the male profile and female profile are interlocked.

8. The zipper closure of claim 1 wherein the ear extends from the second base at an angle of 75-95°.

9. The zipper closure of claim 1 further including:

(a) a first attachment flange extending from the first profile;

(b) a second attachment flange extending from the second profile; and wherein the first and second attachment flanges are contained within planes generally parallel to a plane containing the first base.

10. A child resistant slider zipper closure system comprising:

(a) a recloseable zipper closure with first and second profiles for interlocking and unlocking; the zipper closure including, (i) the first profile having a first base, a pair of spaced legs extending from the first base, and a stub defining a free terminal end surface at an uppermost portion of the first base;

(ii) the second profile having a second base and a stem with a head extending from the second base and sized to be received within the pair of spaced legs of the first profile;

(A) the second profile including an ear extending from the second base and sized to rest on the free terminal end surface of the stub, when the first and second profiles are interlocked;

(B) a parting line between the first and second profiles being between and against the ear and the stub;

(b) a slider being slidably located on the zipper closure; the slider including a top member, a bottom member, a first end wall, and first and second legs extending from the bottom member at least partially toward the top member;

(i) the top member of the slider adapted to move along upper edges of the zipper closure with the first and second legs straddling the zipper closure in a closing direction, interlocking the first and second profiles and in an opening direction, unlocking the first and second profiles;

(ii) the slider including an ear-receiving channel defined by the first leg and the top member; the ear receiving channel including an opening in the first end wall and being laterally spaced from a central plane bisecting the slider, the central plane being orthogonal to the top member; the ear extending from the second base at an angle of 70-100°;

wherein when the slider is moved in the closing direction, the ear of the second profile slides through the ear-receiving channel to align the stem and head within the spaced legs to interlock the first and second profiles together.

11. The slider zipper closure system according to claim 10 wherein:

(a) the slider further includes a splitter extending from the top member;

(b) a notch is defined by the first and second profiles; the notch being spaced from an end of the slider zipper closure system; and (c) when the splitter is engaged with the notch, the splitter holds the ear of the second profile to guide the ear into the ear-receiving channel to retain the ear in an opening position while moving the slider in the opening directing to separate the first and second profiles.

12. The slider zipper closure system according to claim 11 wherein the slider further includes:

(a) a second end wall;

(b) the top member having an open volume gap, free of other slider structure, and separating the top member between a first section and a second section;

(i) the first section of the top member being adjacent to the first end wall; the first section having an inner surface at the first end wall facing the bottom member;

(A) a first part of the inner surface connected to and being within an inner surface plane orthogonal to the second leg;

(ii) the second section of the top member being adjacent to the second end wall;

(c) the ear-receiving channel being recessed from the inner surface plane;

(d) the splitter extending from the second section of the top member; and (e) the first and second legs having internal surfaces spaced sufficiently close together to press the first and second profiles into interlocking relationship as the slider is moved in the closing direction along the zipper closure.

13. The slider zipper closure system according to claim 12 wherein the slider further includes an arm projecting from the first section of the top member such that the ear-receiving channel is defined by the arm, the first slider leg, and the first section of the top member.

14. The slider zipper closure system according to claim 13 wherein the second section of the top member is spaced above the first and second slider legs of the base such that there is a cavity of open volume in between the second section and the first and second slider legs.

15. The slider zipper closure system according to claim 10 further including:

(a) a first attachment flange extending from the first profile; and (b) a second attachment flange extending from the second profile.

16. A flexible package using the slider zipper closure system of claim 15 comprising:

(a) first and second panels each having a top forming a mouth, a bottom, and first and second opposing sides, the first and second panels being joined to each other along their respective bottoms, their respective first opposing sides, and their respective second opposing sides; and (b) wherein the first attachment flange is secured to the top of the first panel; and the second attachment flange is secured to the top of the second panel.

17. The slider zipper closure system according to claim 10, wherein the ear extends from the second base at an angle of 75-95°.

18. A zipper closure comprising:

(a) a female profile having a first base, first and second spaced legs extending from the first base, and a stub defining a free terminal end surface at an uppermost portion of the first base;

(b) a male profile having a second base and a stem with a head extending from the second base, sized to be received within the first and second legs of the female profile for interlocking;

(c) the second profile having an ear extending from the second base and sized to rest on the free terminal end surface of the stub;

(i) the ear being spaced from and axially overlapping the second leg, when the male profile and female profile are interlocked; the ear extending from the second base at an angle of 70-100°; and wherein the female profile and male profile are constructed and arranged to be engaged along a parting line between and against the ear and the stub.

19. The zipper closure of claim 18, wherein the parting line is contained within a plane orthogonal to a plane containing the first base.

20. The zipper closure of claim 18, wherein the ear extends from the second base at an angle of 75-95°.

* * * * *